United States Patent [19]

Mazzorana

[11] 4,319,139

[45] Mar. 9, 1982

[54] STARTER-MOTOR ASSEMBLY

[75] Inventor: Alfred B. Mazzorana, Venissieux, France

[73] Assignee: Société de Paris et du Rhône, Lyons, France

[21] Appl. No.: 102,333

[22] Filed: Dec. 11, 1979

[30] Foreign Application Priority Data

Dec. 12, 1978 [FR] France ..... 78 35494
Nov. 21, 1979 [FR] France ..... 79 29327

[51] Int. Cl.[3] ..... F02N 11/00

[52] U.S. Cl. ..... 290/38 C; 290/38 R; 74/9

[58] Field of Search ..... 290/38 R, 38 C, DIG. 1; 74/9

[56] References Cited

U.S. PATENT DOCUMENTS 1,533,373 4/1925 Brisbois ..... 74/9
1,939,405 12/1933 Nardone ..... 290/38 C
3,521,076 7/1970 Hayon ..... 290/38 R
3,532,895 10/1970 Castillo ..... 290/38 R

FOREIGN PATENT DOCUMENTS 746816 3/1956 United Kingdom ..... 290/38 R

*Primary Examiner*—J. V. Truhe
*Assistant Examiner*—Shelley Wade
*Attorney, Agent, or Firm*—Karl F. Ross

[57] ABSTRACT

An internal-combustion starter assembly has a starter motor whose axially displaceable output gear meshes in a forwardly advanced position with an engine gear and which is out of mesh with this engine gear in a backwardly retracted position. Operating mechanism for this gear includes a control motor having a rotary output shaft carrying a cam with a noncircular cam periphery. A cam follower is radially engageable with this cam periphery and is coupled by means of a control rod and a link to the starter-motor gear to displace this gear between its advanced and retracted positions on rotation of the cam through 360°. A control arrangement includes a start switch for operating the control motor to displace the starter-motor gear from its retracted position into its advanced position and then back into its retracted position, and for energizing the starter motor when the starter-motor gear is in the advanced position. This control means can comprise a switch partly carried on the shaft of the control motor, which itself can be of the two-speed type for low-speed, high-force advance of the starter gear toward the engine flywheel and high-speed, low-force retraction therefrom.

20 Claims, 13 Drawing Figures

STARTER-MOTOR ASSEMBLY

FIELD OF THE INVENTION

The present invention relates to a starter-motor assembly. More particularly this invention concerns such as assembly used to give the initial rotary impetus to an internal-combustion engine.

BACKGROUND OF THE INVENTION

A motor vehicle normally has an internal-combustion engine having an output shaft provided with a large-diameter flywheel formed on its edge with a periphery of drive teeth. A heavy-duty electrical motor is mounted adjacent to this flywheel and itself drives a small-diameter pinion which can mesh with the teeth of the flywheel, achieving a considerable speed reduction, to turn over the engine so that it can start. It is normally necessary to displace the pinion parallel to its axis of rotation into and out of mesh with the teeth of the flywheel, so that during normal operation of the engine the starter motor is not coupled to it.

Several systems are known for achieving this axial displacement of the starter gear or pinion. The most common one is of the so-called BENDIX type wherein the pinion is provided with an off-center weight and is carried between a pair of abutments on a compound thread on the output shaft of the starter motor. On the starter motor commencing rotating its output shaft the imbalanced gear therefore is screwed axially toward the flywheel until it meshes therewith. Once this gear has been screwed all the way to the end of its travel it stops and torque is transmitted between the output shaft of the starter motor and the flywheel. Once the internal-combustion engine catches, the flywheel rotates at a peripheral speed greater than that of the pinion so that the pinion is effectively screwed back down into the shaft and out of engagement with the flywheel. Such an arrangement has the advantage of considerable simplicity, yet has a relatively short service life due to the considerable shock that it must withstand as the pinion moves axially rapidly into mesh with the flywheel teeth, and as the pinion reaches either end of its travel.

For this reason systems have been suggested whereby a simple heavy-duty solenoid is effective through a pivotal fork to displace the starter gear axially on axially extending splines on the output shaft of the starter motor. The solenoid can displace the starter gear forwardly, and a heavy-duty spring urges it continuously backwardly so that the solenoid is deenergized and the starter gear is moved out of mesh with the flywheel teeth. Normally an overruning as one-way clutch is provided between the starter gear and the starter motor to prevent the internal-combustion engine from back-driving the starter motor. This system has the disadvantage that the solenoid, once again frequently subjected to severe shocks, has a short service life.

Another classic problem with these known types of starters is that as the starter gear is moved axially to mesh with the flywheel teeth the teeth of the gear and the teeth of the flywheel come into axial contact with each other, clashing and occasionally preventing meshing of the two. Mounting the pinion for limited angular motion relative to the output shaft by means of a heavy-duty spring overcomes this disadvantage, but once again introduces a failure-prone element into the mechanism.

It has been suggested in British Pat. No. 1,243,920 to avoid the use of a massive solenoid by employing a rotary control motor that drives a worm engaged by a nut connected directly or indirectly to the starter-motor pinion. The disadvantage of this system is that the speed both axially forwardly into engagement with the teeth of the flywheel and axially backwardly away from the flywheel due to the simple mechanics of the system is substantially the same and is, in fact, very slow. Thus the user of such an arrangement must inherently deal with a relatively sluggish starter, one that cannot be actuated and actuated immediately again, but wherein some time must elapse between actuations, for the control motor to screw back the starter-motor gear.

OBJECTS OF THE INVENTION

It is therefore an object of the present invention to provide an improved starter-motor assembly for an internal-combustion engine.

Another object is to provide such as assembly which can be produced at relatively low cost.

Yet another object is to provide such an assembly wherein the starter gear can be brought slowly and with considerable axial force into engagement with the flywheel teeth, but wherein it can also be rapidly retracted from engagement therewith.

These objects are attained according to the instant invention in an operating mechanism having a control motor having an output shaft rotatable about a control-motor axis and carrying a cam having a non-circular cam periphery fixed on the output shaft. A cam follower is radially engageable with this cam periphery and is connected by means of a link to the starter-motor gear for displacing same between its advanced and retracted positions on rotation of the cam by the control motor. Control means is provided including a start switch for operating the control motor to displace the starter-motor gear from its retracted position out of mesh with the flywheel into its advanced postion in mesh therewith and thenback into its retracted position and for energizing the starter motor when the starter-motor gear is in the advanced postion.

It is therefore possible according to the instant invention to use a relatively small, fractional horse power motor which will nonetheless develop the desired low speed and high force during axial forward advance of the starter gear and high speed during the axially backward withdrawal thereof. The shape of the cam periphery substantially determines the ratio of angular displacement of the cam to axial displacement of the cam follower so that virtually any speed can be obtained. The system according to the instant invention makes it possible to use a relatively inexpensive motor such as a windshield-wiper motor, which is mass produced and very cheap. Such a small motor can be used even for the relatively massive starter assembly for a truck or other large vehicle.

According to features of this invention the periphery of the cam is formed substantially as a spiral, increasing in radius of curvature in the normal rotation direction of the cam and formed with a radial step defining a high point and a low point. Thus given a constant motor torque exerted on the cam the force transmitted to the cam follower is at a maximum at the start of cam rotation, that is when the cam follower is engaging or adjacent to the low point of the cam periphery, and decreases as the cam rotates so that the follower is juxtaposed with the high point.

According to this invention the link is constituted as a fork operating as a first-class lever and pivoted on the housing of this starter assembly. One end of this fork is connected via a bearing and unidirectional clutch to the starter gear, and the other end is engaged by one end of the control rod carrying on its other end the above-mentioned cam-follower roll. The end of the control rod carrying the cam-follower roller may be pivoted at one end of a link whose other end is pivoted on the housing. A spring urges the control rod in a direction corresponding to the retracted position of the starter gear, and also corresponding to displacement of the cam-follower roller toward the cam periphery. According to features of this invention the mechanism is set up, normally by providing an abutment engageable with the control rod, link, or other associated structure, which holds the cam-follower roller slightly out of contact with the cam periphery when radially juxtaposed with the low point thereof. In this manner vibration and noise will not be transmitted across this starter mechanizm.

According to another feature of this invention the control motor is of the two-speed type, having a low-speed and a high-speed terminal. The low-speed terminal is energized from the hot side of the electrical source of the vehicle during axial forward advance of the starter gear from the retracted position into the advanced position, whereupon the control means is normally set up to deenergize the motor. The high-speed terminal is, however, energized for displacement of the starter gear from the fully axially advanced position to the retracted position, so that once the engine is started the starter gear is rapidly moved out of the way, it being recognized that substantially less force is needed to disengage the starter gear from the flywheel than to engage it therewith. That effect can be achieved by means of a reversing switch engaged by the control rod along with operation of the starter switch and another switch operated by the cam itself. This other switch is preferably of the SPDT type and is formed as conductive regions and wipers carried on the cam or on a disk rotationally coupled to the cam. This SPDT cam switch can also serve to ground the high-speed terminal of the control motor, which, when grounded, acts as an electrical brake.

It is possible to constitute the reversing switch as a simple SPDT switch which is movable from a position with its pole engaging one of its contacts to a position with its pole engaging the other of its contacts when the gear of the starter motor moves from the retracted to the advanced position.

In order to make it possible to adjust the operation of this reversing switch relative to the angular position of the cam it is possible according to this invention to provide a separate support disk on the output shaft of the control motor which is angularly displaceable on this output shaft relative to the cam. In such an arrangement it is further possible to provide a heavy-duty plunger-type switch which can itself carry the considerable current needed by the starter motor, and which can therefore replace the light-duty reversing switch described above and the relay it operates to energize the starter motor. This starter-motor switch has a plunger normally biased toward the support disk and is engageable by an operating member which can be displaced backwardly by the projection of a lever on the support disk to close the starter-motor switch. To this end an abutment is provided relative to the direction of rotation of the support disk immediately upstream of this operating member, so that the lever is depressed inwardly or cocked as it passes this abutment. Once past the abutment, however, the lever springs radially outwardly to strike the operating element and thereby close the plunger-type starter switch. This position normally corresponds to a position wherein the other SPDT cam switch of the system open-circuits the control motor so that the starter motor can remain energized for as long as is necessary to start the vehicle. Once the starter switch, normally comprised as a pair of SPST switches, is released the control motor is normally energized again to rotate the cam further so that the cam follower can drop down from the high point to the low point and axially withdraw the starter gear from the flywheel.

The various cam switches can be formed, according to this invention, by disks carried on or coupled to the cam and constituted as conductive surfaces engaged by wipers in such a manner that as the cam rotates the necessary circuits are opened and closed.

Thus with the system according to the instant invention it is possible to move the starter gear at relatively low speed and with considerable force axially forwardly to mesh with the teeth of the flywheel. It can be nonetheless withdrawn at high speed, both owing to the pitch of the cam periphery and the optional two-speed operation of the motor, so that the system, while using a relatively inexpensive fractional-horsepower motor, will nonetheless operate efficiently in all phases. The relatively simple operating mechanism according to this invention can be mounted on even an extremely large starter assembly for a truck or the like, and will provide adequate service over a long time for a relatively limited cost.

SPECIFIC DESCRIPTION

Figure 1:
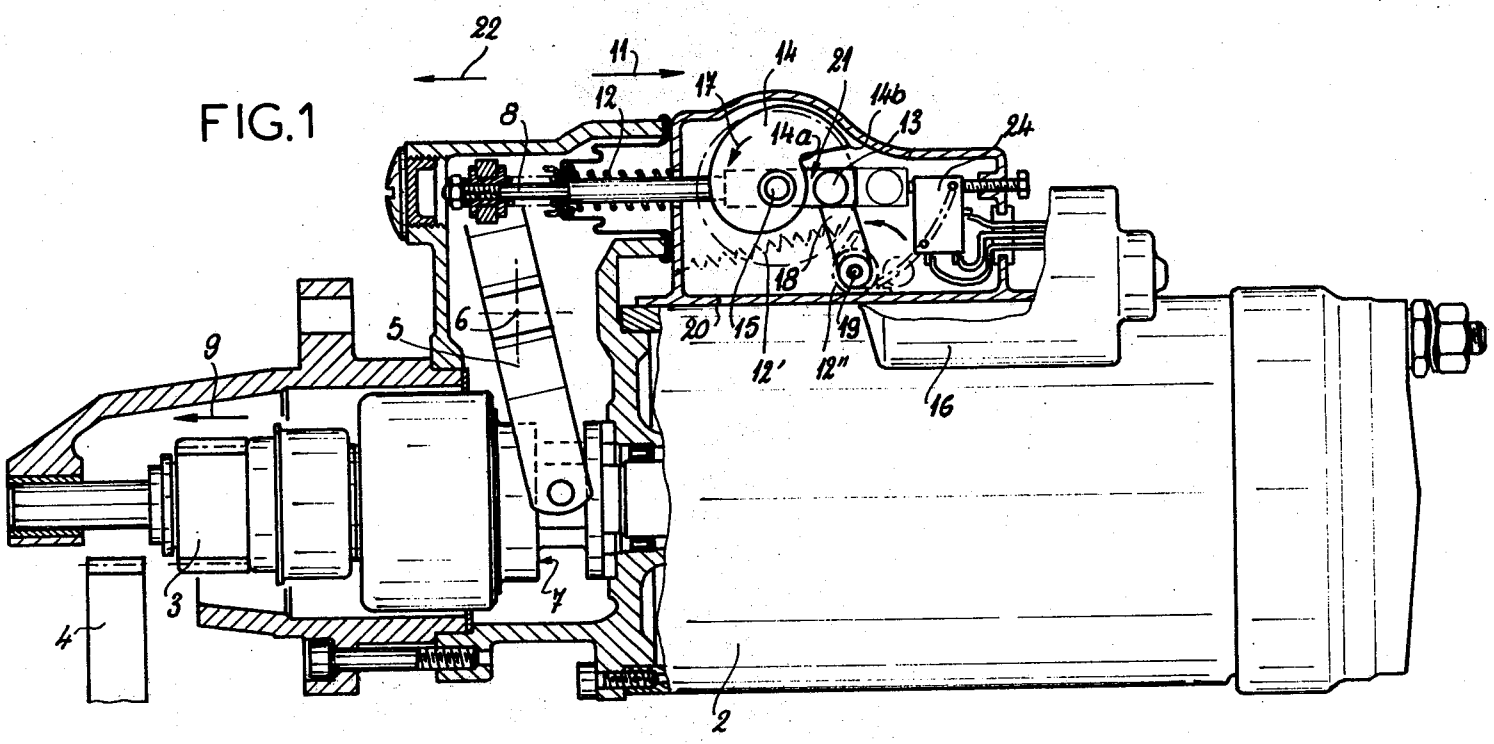
FIG. 1 is a side partly-sectional view of the starter according to the instant invention.

As seen in FIG. 1 a starter according to this invention basically comprises a heavy-duty starter motor 2 equipped with mechanism 1 for engaging a gear 3 splined on the output shaft of this motor 2 with teeth formed on the edge of the flywheel 4 of the internal-combustion engine to be started by the motor 2. To this end a fork 5 is pivoted on the housing 20 of the assembly at 6 and engages in a groove 7 of a bearing mounted on an overrunning or one-way clutch 10 by means of which the gear 3 is rotationally coupled to the motor 2. A control rod 8 is displaceable forwardly in the direction indicated by arrow 9 and backwardly in the direction indicated by arrow 11 by means of the mechanism 1. When the rod 8 pulls backwardly in the direction 11 indicated in FIG. 1 it pivots the lever 5 about the pivot 6 and displaces the bearing 7, clutch 10, and gear 3 forwardly in the direction 9 so as to mesh the teeth of the gear 3 with those of the flywheel 4. This couples the flywheel 4 to the starter motor 2 so that the starter motor 2 can rotate the flywheel 4 and thereby start the engine connected to it.

The main control rod 8 carries at one end a nut 22 engaged with the fork 5. A coil-type compression spring 12 is braced between a snap ring on the control rod 8 and the housing 20 and urges it forwardly in the direction 9. At its rear end the control rod 8 carries a cam roll 13 normally urged forwardly into contact with a cam 14 having a spiral-shaped surface with a low point 14*a* and a high point 14*b*. This cam-follower roller 13 is also carried at one end by a short link 18 pivoted at 19 on the housing 20, and serving as the rear-end support for the control rod 8. Instead of or in addition to the coil spring 12 a tension spring 12′ hooked between the housing 20 and the link 18 may be employed, or a torsion spring 12″ hooked over the link 12 and bearing against the housing 20. All of these springs 12, 12′, and 12″ bias the rod 8 forwardly in direction 9.

The cam 14 is carried on a shaft 15 of a fractional horsepower motor/transmission unit 16 forming part of the operating mechanism 1 and operable in a single direction to rotate the cam 14 in the direction indicated at arrow 17 in FIG. 1. When the cam follower 13 is aligned with the low point 14*a* of the cam 14 a small space or play 21 exists between these two members. When moved into its rearmost position indicated in dashed lines in FIG. 1, the rear end of the rod 8 can engage and operate a reversing switch 24.

As shown in more detail in FIGS. 2–5 the system is adapted to be operated by a motor-vehicle electrical system having a plus or hot side 25 and a grounded or negative side. The system includes a start switch 27 constituted basically as a pair of ganged SPST switches alternately closable, with a pair of normally closed back contacts 28*a* and 28*b* and a pair or normally open front contacts 29*a* and 29*b*. The reversing switch 24 is of the SPDT type, having a pole 24*a*, a back terminal 24*b*, and a front terminal 24*c*. The motor 16 is of the two-speed type, and has a terminal 16*a* connected to ground, a low-speed terminal 16*b* connected to the back contact 24*b* of the switch 24 and a high-speed terminal 16*c* connected to the back terminal 28*a* of the switch 27.

The cam 14 carries a switch assembly 31 constituted as an outer circular disk 31*a* centered on the rotation axis for the cam 14 and a central keyhole-shaped disk 31*b* whose round part is centered on the rotation axis for the cam 14, but which is insulated by means of an insulating layer 32 from the disk 31*a*. Both of the disks 31*a* and 31*b* are made of an electrically conductive material such as copper. A wiper 33 connected to the hot line 25 rides continuously on the outer disk 31*a* and never contacts the portion 31*b*. Another grounded wiper 34 rides continuously on the round part of the portion 31*b* and it never contacts the disk 31*a*. Between these two wipers 33 and 34 a wiper 35 connected to the back contact 28*b* of the switch 27 rides, depending on the angular position of the cam 14, either on the inner portion 31*b* or the outer portion 31*a*. Thus the switch assembly 31 is in effect a SPDT switch, with the wiper 35 constituting the pole and the wipers 33 and 34 constituting the two elements with which it can be electrically connected, in dependence on the angular position of the cam 14.

The starter motor 2 has a grounded terminal 2*a* and another terminal 2*b* connected to one of the contacts 26*a* of an SPST relay 26 whose other contact 26*b* is connected to the hot line 25. The winding 26*c* of this relay 26 is connected on one side to ground and on its other side to the front terminal 24*c* of the reversing switch 24.

Figure 2:
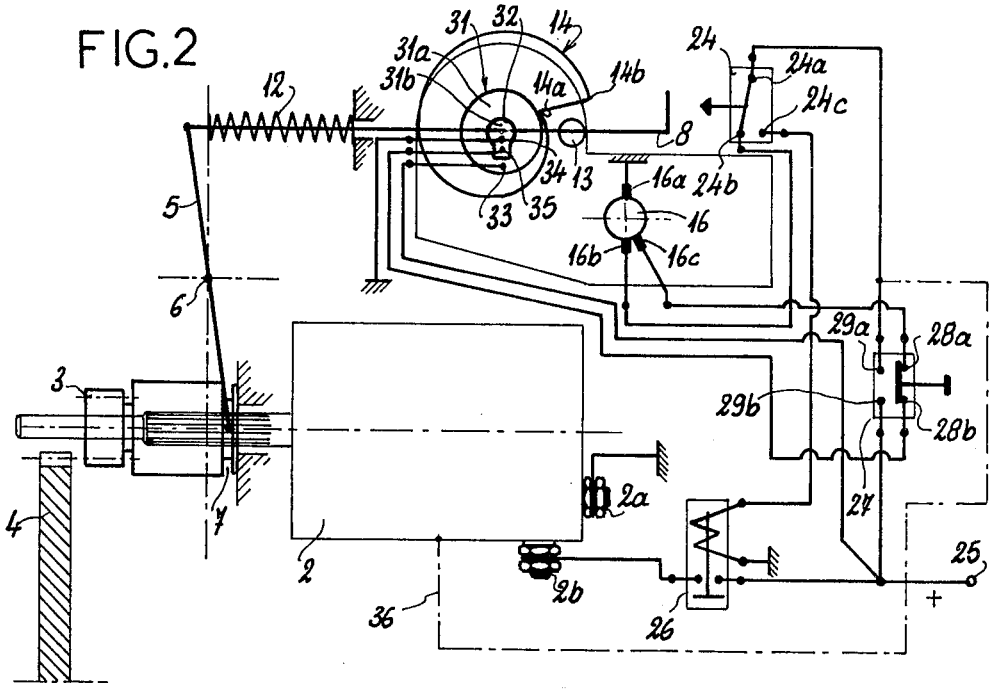
FIGS. 2–5 are schematic views illustrating the operation of the starter of FIG. 1.

The system described above operates as follows:

In the rest position as shown in FIG. 2 the back contacts 28*a* and 28*b* of the start switch 27 are connected together, so that the middle contact 35 of the switch assembly 31 is connected via the portion 31*b* to the ground wiper 34. In addition the reversing switch 34, which is not contacted by the control rod 8, has its pole 24*a* lying against its back contact 24*b*, but since this pole 24*a* is de-energized as the contacts 29*a* and 29*b* are open-circulated, this has no effect whatsoever on the circuit.

Figure 3:
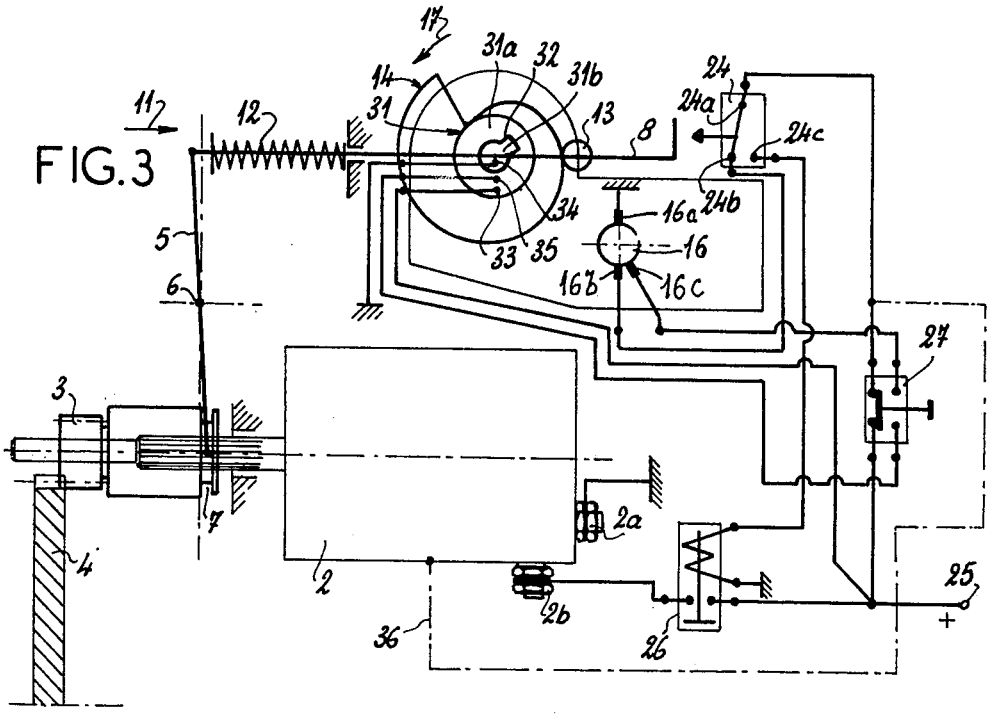

When the starter switch 27 is actuated as shown in FIG. 3 the contacts 29*a* and 29*b* are connected together and the contacts 28*a* and 28*b* are open-circuited. This action energizes pole 24*a* of the reversing switch 24 so that current flows via the contact 24*b* to the low-speed winding terminal 16*b* of the motor 16. The motor 16 therefore rotates its shaft 15, and, with it, the cam 14 in the direction 17. As the contact 35 moves off the portion 31*b* and onto the portion 31*a* it becomes energized from the hot line 25, but since the contacts 28*a* and 28*b* are open-circuited this has no effect. The result is a camming of the control rod 8 in direction 11 so as to move the starter gear 3 in direction 9 to engage its teeth with those of the flywheel 4.

Figure 4:
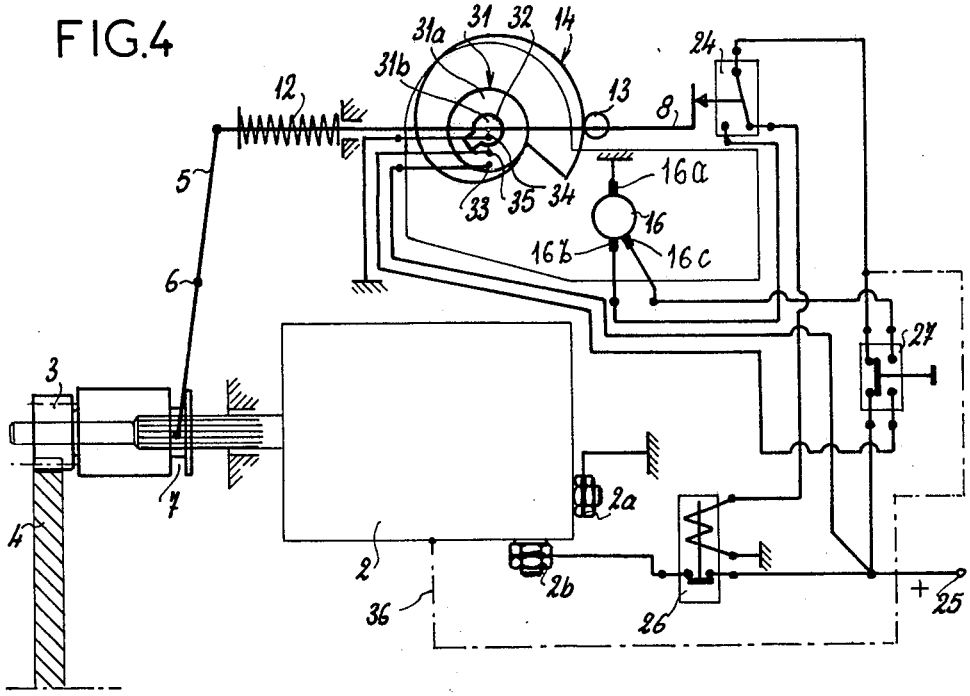

As shown in FIG. 4 the cam 14 will continue to rotate until the control rod 8 engages the reversing switch 24 and pushes its pole 24*a* away from its back contact 24*b* and into engagement with its front contact 24*c*. This action, therefore, energizes the coil 26*c* of the relay 26 from the hot line 25 so as to energize the motor 2. At this time the gear 3 will be fully engaged with the teeth of the flywheel 4 so that full driving force can be transmitted to the flywheel 4. As the pole 24*a* moves from the contact 24*b* to the contact 24*c*, however, it open-circuits the low-speed terminal 16*b* of the motors 16 which, therefore, stops rotating. In this position so long as the button of the starter switch 27 is held down, the motor 2 will drive the engine of the vehicle. Once the engine starts, however, the user releases the starter switch 27 so that it jumps back, open-circuiting the contacts 29*a* and 29*b* and short-circuiting the contacts 28*a* and 28*b*. Since in this angular position of the cam 14 the wipers 33 and 35 form a closed circuit, the result is energization of the high-speed winding terminal 16*c* of the motor 16 which, therefore, rapidly rotates the cam 14 further in direction 17 until the cam-follower roller 13 carried on the control rod 8 is aligned with the low point 14*a* on the cam 14. Once thus aligned the entire control rod 8 will move forwardly in direction 9, pulling the gear 3 backwardly in direction 11 to disengage it from the teeth on the flywheel 4. The motor 16 will continue to rotate the cam 14 in the direction 17 until, however, the pole 35 rides up on the portion 31*a*, simultaneously de-energizing the terminal 16 and, in fact, connecting it to ground. In the type of motor used according to the instant invention such grounding of the terminal 16*c* will stop the motor 16 immediately, arresting it in the position of FIG. 2.

Thus, with the system according to the instant invention a simple and relatively small motor/transmission unit 16 of very low horse power can effectively connect the heavy-duty starter motor 2 to the flywheel 4. The motor/transmission unit 16 is, according to this invention, of the exact type used to operate the windshield wipers of the motor vehicle, so that it is of the mass-production type and relatively inexpensive. Even though such a small motor-transmission unit is used, the considerable stepdown achieved both by the transmission built into such motor and by the use of the cam 14 ensures that the gear 3 will be moved forwardly with considerable force.

Figure 5:
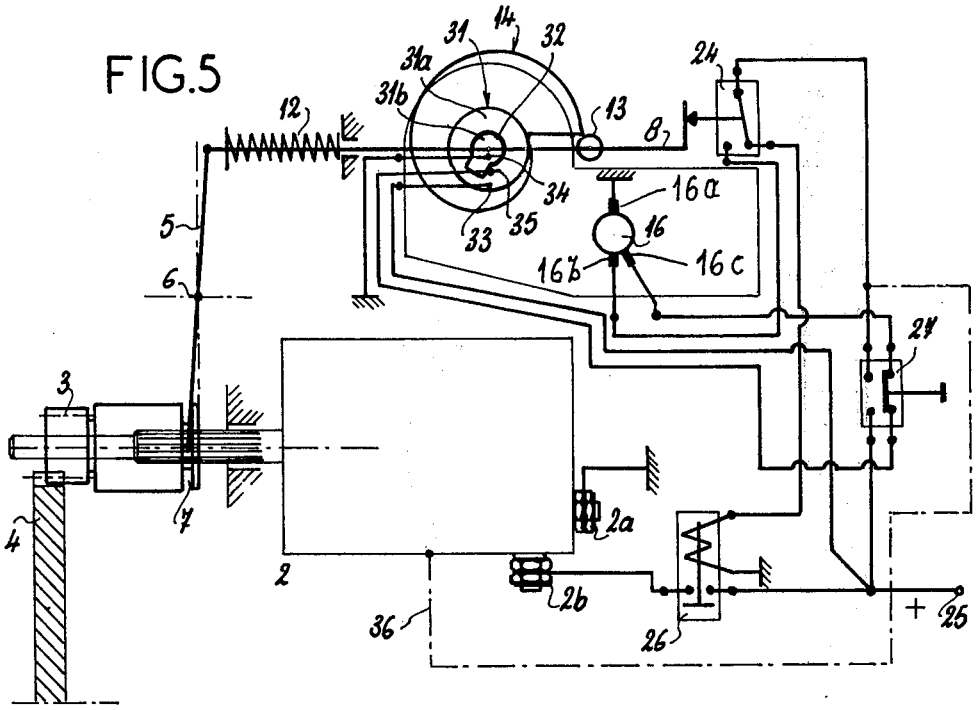

FIGS. 2 and 5 also show an electrical connection 36 between the front contact 29*a* of the switch 27 and a low-Wattage winding of a motor 2 in the event that this motor 2 is of the compound type and has a low-Wattage starter winding. Operating the motor 2 at low power as the gear 3 is being engaged with the teeth of the flywheel 4 is advantageous in that it prevents direct clashing of the gears, with the gear 3 rotating fast enough so that inevitably it fits between the teeth of gear 4 without damage, as the low-speed winding connected to the line 36 cannot exert considerable torque on the gear 3 this cannot result in damage to the teeth on the flywheel 4.

The embodiment of FIGS. 6–9 is similar to that of FIGS. 1–5, with identical reference numerals representing identical structure. In this arrangement, however, means is provided for adjusting the opening and closing positions of the various switches independently of the angular position of the cam 14, and for eliminating the heavy-duty starter relay necessitated in the arrangement of FIGS. 1–5 since the reversing switch 24 cannot normally carry a heavy current.

Figure 6:
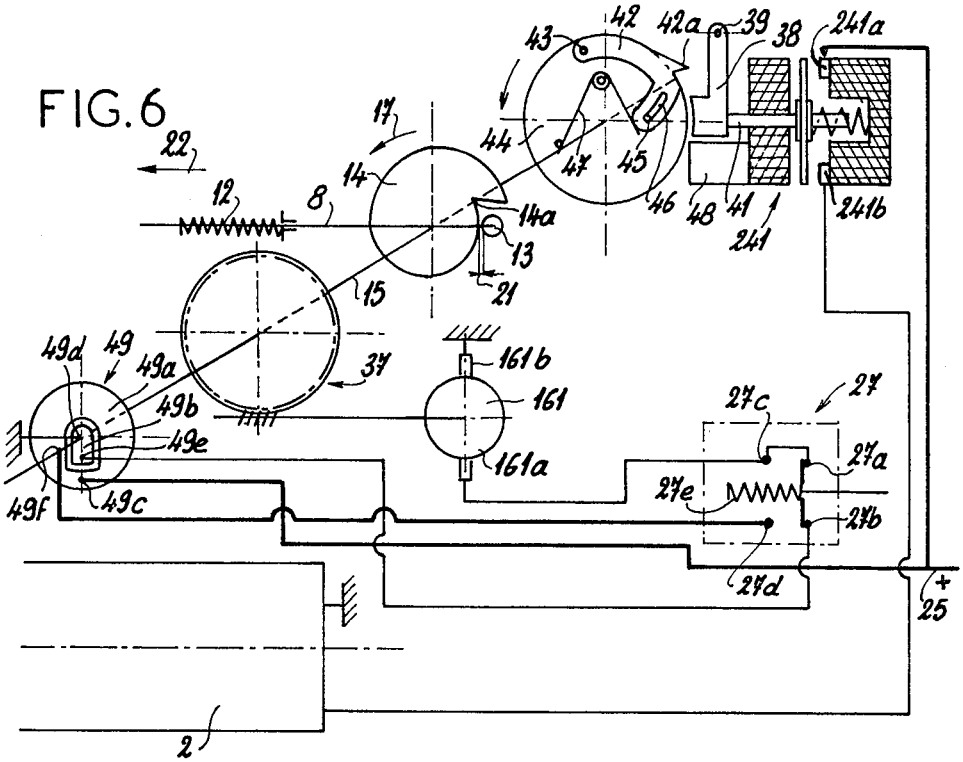
FIGS. 6–9 are schematic views illustrating another starter according to this invention.

Thus in FIG. 6 there is a single-speed motor 161 having a grounded terminal 161*b* and a main terminal 161*a* which takes the place of the motor 16, but which drives a worm 161*c* that meshes with a main drive gear 37 operating a shaft 15' on which the cam 14 is fixed by means of a collar 23 having an adjustment screw 23*a* which allows its angular position on this shaft 15' to be varied. In addition the shaft 15' carries, as will be described in more detail below, a support disk 44 and another support disk 49, both which may also be provided with screw collars 23 as shown for cam 14.

The support disk 49 is of insulating material which carries on one face a disk 49*a* and at its center an elongated portion 49*b* insulated from the portion 49*a*. An outer wiper 49*c* continuously engages the main portion 49*a* and can never engage the portion 49*b*. Similarly an innermost wiper 49*d* engages only the portion 49*b* and is grounded. A pair of intermediate wipers 49*e* and 49*f* can engage either the outer portion of 49*a* which is always hot or the inner portion 49*b* which is always grounded, depending on the angular position of the disk 49.

Here a starter switch 27' has a pair of back contacts 27*a* and 27*b* and a pair of front contacts 27*c* and 27*d*, and a spring 27*e* which normally urges it into a position with its contacts 27*a* and 27*b* short-circuited. In this arrangement the contacts 27*a* and 27*c* are connected together and to the sole hot terminal 161*a* of the motor 161. The back terminal 27*b* is connected only to the wiper 49*e* and the front terminal 27*b* is connected only to the wiper 49*f*. Thus the switch 27' is in effect a SPDT switch which connects the hot terminal 161*a* of the motor 161 either to the wiper 49*e* or to the wiper 49*f*, either of which in turn can be connected either to the hot wiper 49*c* or to the ground, depending on the angular position of the disk 49.

In addition the support disk 44 carries a lever 42 mounted on a pivot 43 and formed with a hole 46 through which engages a stop pin 45. A spring 47 normally urges the lever into a radial outer position, with a point or spur 42*a* on the lever extending outwardly from the periphery of the disk 42.

Mounted on the housing 20 adjacent the rotatable support disk 44 for the lever 42 is a fixed abutment 48 engageable with the spur 42*a*. Immediately adjacent this abutment 48 is a depressable hammer 38 pivoted at 39 on the housing 20 and having a stem 41 connected to a plunger-type switch 241 having a switch contact 241*a* connected to the hot lint 25 and a switch contact 241*b* connected to the hot terminal 2*b* of the starter motor 2. The switch 241 is capable of conducting considerable current between the contacts 241*a* and 241*b* by bridging across these contacts with a switch element 241*c* carried on the rod 41.

In the rest position shown in FIG. 6 the cam follower 13 is spaced by the play 21 from the low part 14*a* of the cam 14 so that the gear 3 is completely out of contact with the teeth of the flywheel 4. In this position the contacts 27*a* and 27*b* are bridged, but since the wiper 49*e* is connected to ground, both sides of the motor 161 are connected to ground so that this motor 161 does not operate. Furthermore the spur 42*a* is spaced immediately downstream in the direction 17 from the hammer 38 so that the switch contacts 241*a* and 241*b* are also not bridged and the start motor 2 is deenergized.

Figure 7:
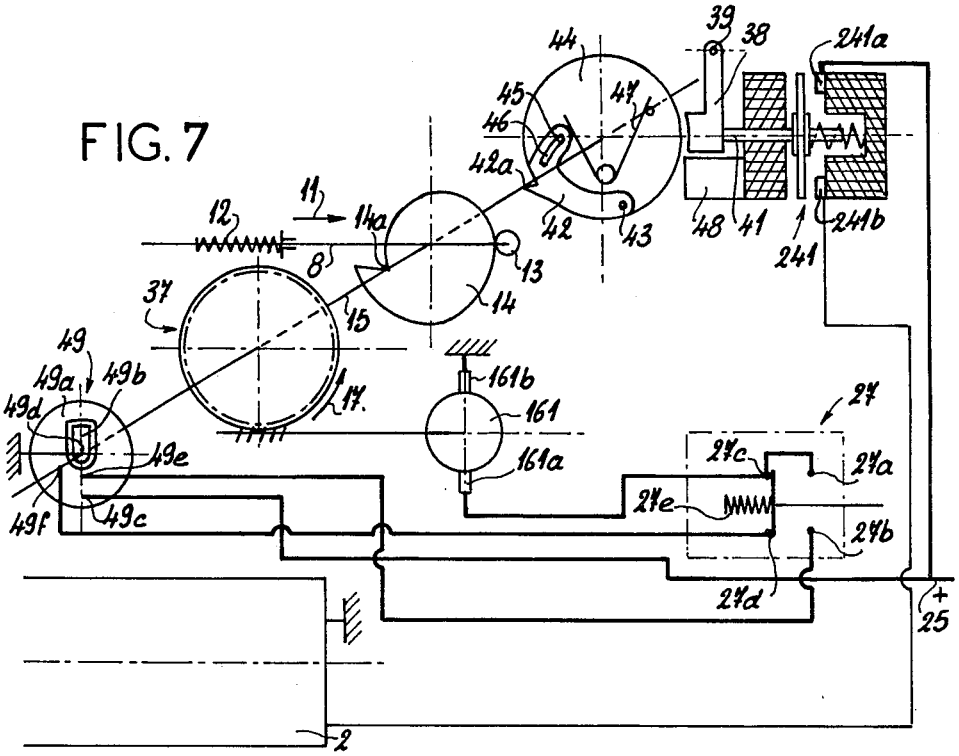

To start the vehicle the switch 27' is operated as shown in FIG. 7 to bridge the contacts 27*c* and 27*d*. Current from the hot line 25 can therefore flow from the wiper 49*c* across the disk 49*a* to the wiper 49*f* and across the bridged terminals 27*c* and 27*d* to the hot terminal 161*a* of the motor 161. This will, of course, energize the motor 161 to rotate the cam 14 as well as the disks 44 and 49 in the direction 17.

Figure 8:
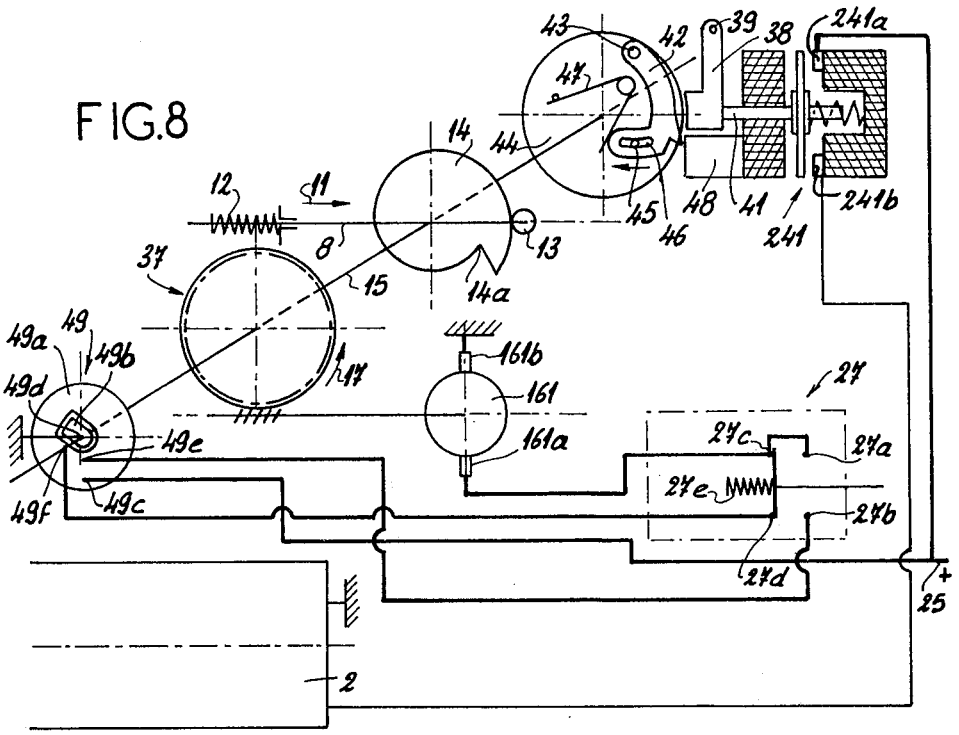

As the motor 161 continues to rotate the disk 44 as illustrated in FIG. 8 the spur 42*a* will come into contact with the fixed abutment 48 thereby pivoting the lever 42 radially inwardly on the support disk 44. During this action the terminals 241*a* and 241*b* of the switch 241 remain open-circuited so that the starter motor 2 is still not energized.

Figure 9:
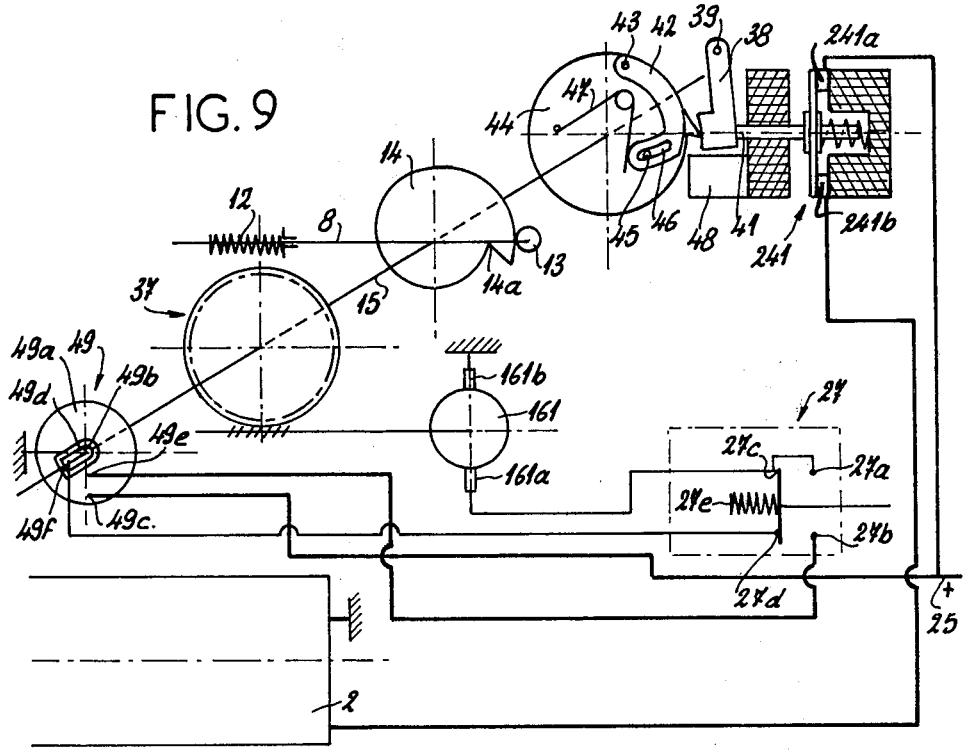

Finally as shown in FIG. 9 the cocked lever 42 moves past the abutment 48 and springs out, driving the lever or hammer 38 inwardly so that the switch element 241*c* bridges the terminals 241*a* and *b* and energizes the starter motor 2. At the same time the wiper 49*f* connected via the terminals 27*c* and 27*d* of the switch 27' to the hot terminal 161*a* of the motor 161 is grounded, immediately electrically braking this motor 161 and completely halting rotation of the cam 14 and disks 44 and 49. This stopping point corresponds to engagement of the cam-follower roller 13 with the high point 14*b* of the cam 14 and with engagement of the spur 42*a* against the hammer 38 so that the switch element 241*c* bridges the terminals 241*a* and *b*. The circuit remains in this position until the internal-combustion engine has caught.

Once the engine has started the user releases the switch 27' so that it returns to the position of FIG. 6. Reconnection of the back terminals 27*a* and 27*b* together by the switch 27' reenergizes the motor 161 briefly until the wiper 49*e* rides up on the grounded postion 49*b* of the switch disk 49. This action once again grounds the motor 161 to stop it immediately.

In the arrangement of FIGS. 6–9 it is possible to adjust the positions of the support disks 44 and 49 independently of each other and independently of the angular position of the cam 14. Normally the cam 14 is itself fixed to the shaft 15' and means is provided as shown at the collar 23 and screw 23*a* for positioning the support disks 44 and 49 in any desired angular position on the shaft 15′.

In order to eliminate the chance that the amount of time the motor 2 is energized for starting is too short the angular dimension of the spur 42*a* as well as of the hammer 38 relative to the axle 15′ can be increased so that the amount of time the motor 2 will inevitably remain energized is dependent upon the angular velocity in the direction 17 and the angular dimensions of these parts. Of course in the event that the engine starts immediately the overrunning clutch 10 will permit the flywheel 4 to operate at a greater peripheral speed than the gear 3.

The arrangement of FIGS. 10–13 is substantially identical to that of FIGS. 6–9, except that a motor 162 is used having a low-speed winding terminal 162*a*, a high-speed winding terminal 162*b*, and a ground terminal 162*c*. In addition the switch 241 is replaced by a switch 242 having a back contact 242*a* connected to the terminal 27*c* of the switch 27′, another back terminal 242*b* connected to the low-speed terminal 162*a*, a front terminal 242*c* connected to the hot line 25 and another front terminal 242*d* connected to the hot terminal 2*b* of the motor 2. Finally the switch 241 mounted on the shaft 15′ is here constituted as a simple SPDT switch having an outer conductive portion 491*a*, an inner conductive portion 491*b*, an inner wiper 491*c* that can ride either on the inner portion 491*b* or on the outer portion 491*a*, an inner wiper 491*d* which always rides on the inner portion 491*b* and an outer wiper 491*e* that always rides on the outer portion 491*a*. The wiper 491*d* is grounded whereas the wiper 491*c* is connected to the terminal 27*b* and the wiper 491*e* is connected to the terminal 27*d* of the switch 27′. In the starting position illustrated in FIG. 10 electricity from the hot line 25 is applied to the terminal 242*c* which is open circuited, and to the wiper 491*e* which engages the outer portion 491*a* which is not engaged by any other wiper. Thus nothing is energized in this position.

Figure 11:
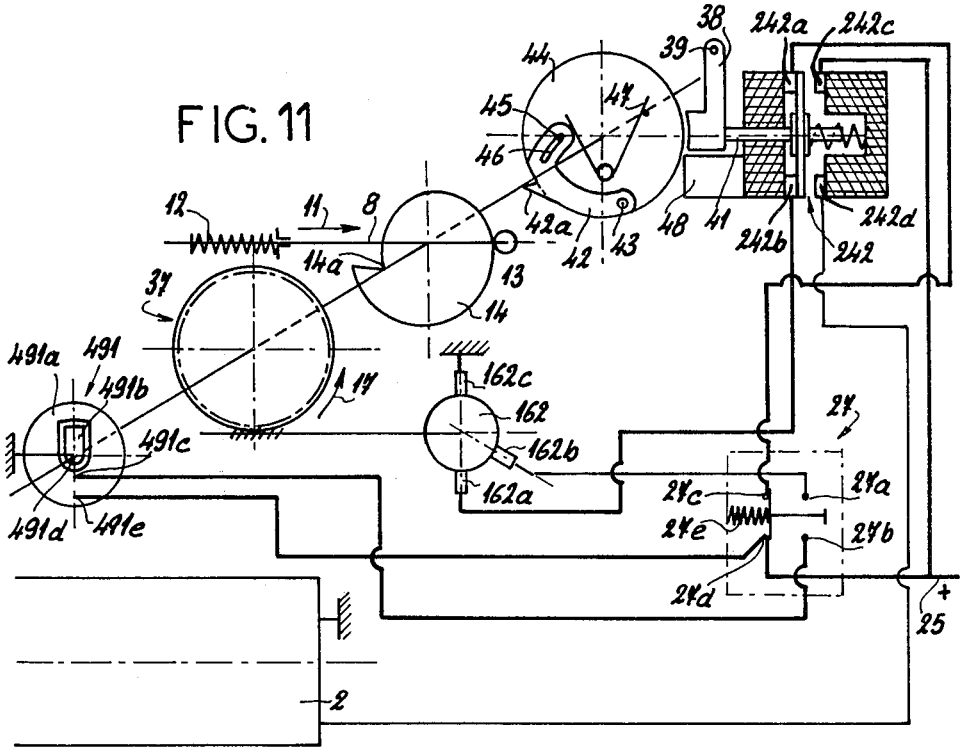

When the switch 27′ is operated as illustrated in FIG. 11 terminals 27*c* and 27*d* are bridged so that the terminal 242*a* is energized and, since this terminal 242*a* is bridged by the switch 242, the terminal 242*b* and the low-speed terminal 162*a* for the motor 162 are also energized. In this position, therefore, the motor 162 operates to turn the shaft 15′ in direction 17, thereby pivoting the support disk 44, the cam disk 14, and the cam switch 491.

Figure 12:
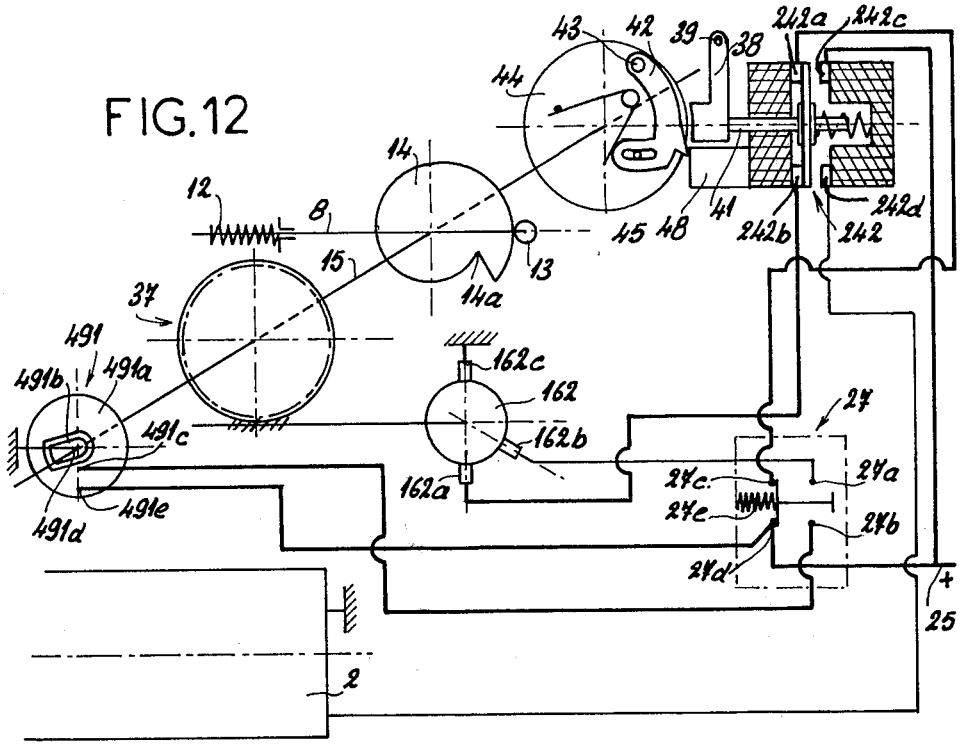

The switch 27′ remains depressed as the lever 42 is cocked as shown in FIG. 12, the motor 162 continuing to operate at low speed.

Figure 13:
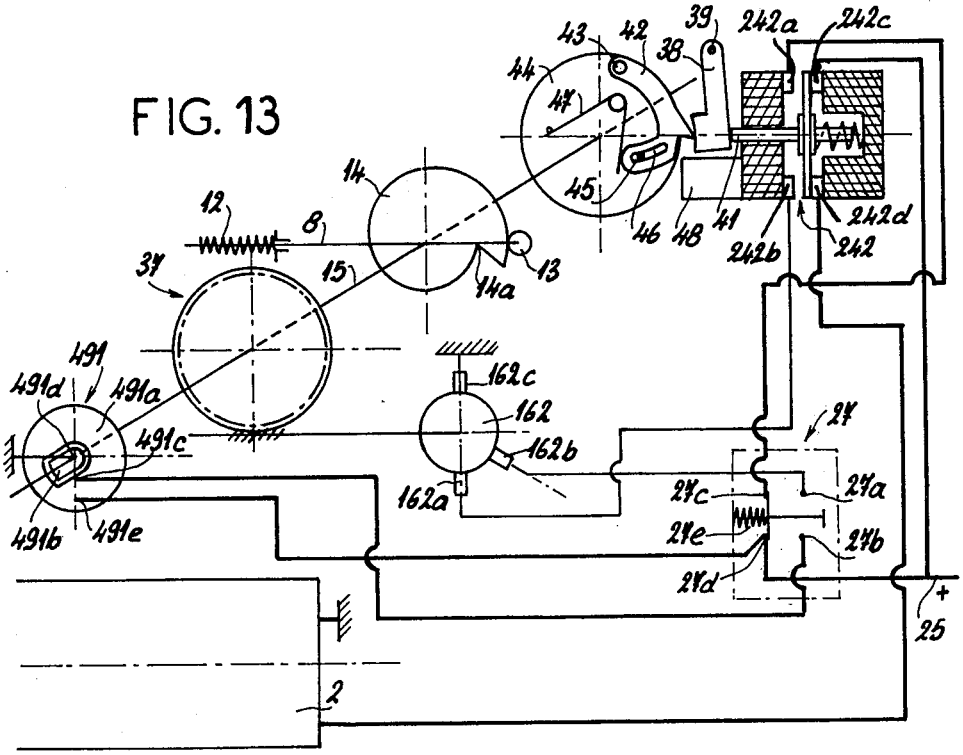

Finally as seen in FIG. 13 the lever 42*a* depresses the rod 41 to bridge the contacts 242*c* and 242*d*, thereby energizing the starter motor 2. This action also open circuits the terminals 242*a* and 242*b* to completely deenergize the motor 162 which, since it is only operating at low speed, does not need to be electrically braked. The switch 27′ is held in the position seen in FIG. 13 until the internal-combustion engine being turned over by the starter motor 2 catches.

Figure 10:
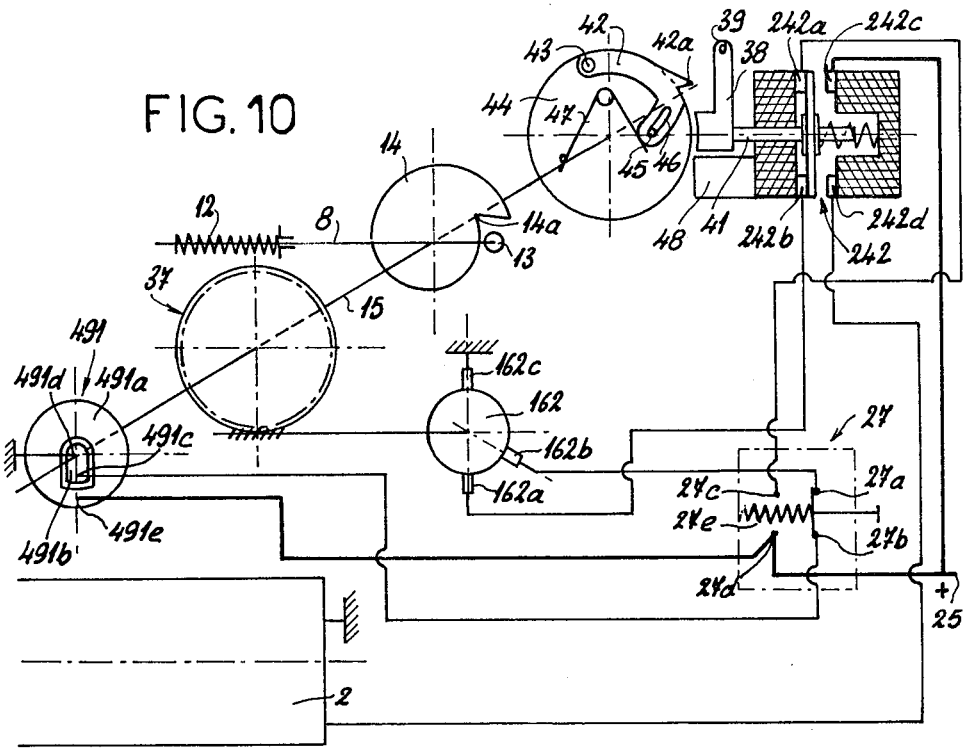
FIGS. 10–13 are schematic views illustrating the operation of yet another starter according to this invention.

Once the motor has caught the user need merely release the switch 27′ so that the spring 27*e* returns it to its starting position of FIG. 10, thereby connecting the high-speed winding terminal 162*b* via the bridged back contacts 27*a* and 27*b* and the connected-together wipers 491*c* and 491*e* to the source 10. The motor 162 will therefore be operated at very high speed to quickly withdraw the gear 3 from the teeth of the flywheel 4. The motor 162 will therefore rotate the shaft 15′ at high speed until the cam-follower roller 13 can be pulled back by the spring 12 into a position adjacent the low point 14*a* of this cam, and until the wiper 491*c* rides up on the central portion 491*d* which is grounded so as immediately to stop the motor 162. The cycle can then be repeated.

Thus with the system according to the instant invention it is possible by using a very small and inexpensive rotary motor to effect all of the operations necessary for engaging and disengaging a starter-motor gear from an engine to be started. The device can easily be powered by a fractional-horsepower electric motor of the type used to operate windshield wipers, so that this arrangement can be produced at extremely low cost due to the ready availability of this mass-production item.

I claim:

1. In an internal-combustion starter assembly wherein a starter motor has an axially displaceable output gear meshable in a forwardly advanced position with an engine gear and unengageable with said engine gear in a backwardly retracted position, an operating mechanism comprising:

a control motor having an output shaft rotatable about a control motor axis;

a cam having a noncircular cam periphery fixed on said output shaft;

a cam follower radially engageable with said cam periphery;

means including a link between said cam follower and the starter-motor gear for displacing same between its positions on rotation of said cam by said control motor; and control means including a start switch for operating said control motor for displacing said starter-motor gear from its retracted position into its advanced position and then back into its retracted position and for energizing said starter motor when said starter-motor gear is in said advanced position.

2. The mechanism defined in claim 1 wherein said control means includes a reversing switch operatively connected to said cam for energizing said starter motor when said starter-motor gear is in said advanced position.

3. The mechanism defined in claim 2 wherein said reversing switch is connected to said control motor for deenergizing same when said starter-motor gear is in said advanced position.

4. The mechanism defined in claim 3 wherein said reversing switch is an SPDT switch.

5. The mechanism defined in claim 4 wherein said control means includes an axially displaceable control and rod connected to said link and carrying said follower, and spring means for urging said cam follower radially toward said cam.

6. The mechanism defined in claim 5 wherein said control rod is engageable with said reversing switch in said advanced position of said starter gear.

7. The mechanism defined in claim 6 wherein said link is a fork acting as a first-class lever and having one end engaging said control rod and another end operatively engaged with said starter-motor gear.

8. The mechanism defined in claim 1 wherein said periphery is substantially a spiral increasing in radius of curvature in the normal rotation direction of said cam.

9. The mechanism defined in claim 8 wherein said periphery has a radial step defining a high point corresponding to said advanced position and a low point corresponding to said retracted position of said starter-motor gear.

10. The mechanism defined in claim 1 wherein said control motor includes a fractional-horsepower electric motor and a stepdown transmission between said electric motor and said output shaft.

11. The mechanism defined in claim 1, further comprising a housing for said control means which includes a control rod connected to said link and carrying said follower and spring means braced between said rod and said housing for urging said follower toward said periphery.

12. The mechanism defined in claim 11 wherein said control rod and link are so adapted and arranged that in said retracted position of said starter-motor gear said cam follower is spaced slightly from said cam periphery.

13. The mechanism defined in claim 1 wherein said control motor includes an electric brake and said control means deenergizes said control motor and operates said brake when said starter-motor gear is in said advanced position.

14. The mechanism defined in claim 1 wherein said starter motor has a ground terminal connected to ground and a hot terminal, said control motor having a ground terminal connected to ground, a low-speed hot terminal, and a high-speed hot terminal, said control means including an SPDT cam switch having a pole and a pair of contacts and displaceable between a position with said pole engaging one of said contacts and a position with said pole engaging the other of said contacts on displacement of said starter-motor gear respectively between said advanced and retracted positions, said starter switch constituting a pair of SPST switch ganged together so one is open when the other is closed and vice versa, said control means including an SPDT reversing switch having a pole and two terminals and operable on displacement of said starter-motor gear between said advanced and retracted positions, said assembly further comprising a source of electricity having a grounded side and a hot side, said high-speed hot terminal being connected through one of said SPST switches to said pole of said cam switch, said pole of said reversing switch being connected through the other of said SPST swiches with said hot side of said source, said low-speed hot terminal of said control motor being connected to that contact of said reversing switch that is engaged by the pole thereof in said retracted position of said gear and the other pole of said reversing switch being operatively connected to said hot terminal of said starter motor to energize same, the contact of said reversing switch coupled to the pole thereof when said gear is in said retracted position being grounded and the other contact of said reversing switch being connected to said hot side.

15. The mechanism defined in claim 14 wherein said cam switch is fixedly operatively linked to said cam.

16. The mechanism defined in claim 15 wherein said control means includes a starter switch connected in series between said hot side of said source and said hot terminal of said starter motor and a support disk rotationally fixed to said cam and carrying a radially displaceable lever having a projection extensible radially beyond said disk and engageable with said starter switch to close same, said disk being provided with a spring urging said lever radially outwardly into a position operatively engageable with said starter switch, said control menas including a fixed abutment immediately upstream in the normal direction of rotation of said disk and engageable with said projection to depress same inwardly and cock said lever.

17. The mechanism defined in claim 16 wherein said abutment has a surface turned toward said disk and approaching said disk in said displacement direction.

18. The mechanism defined in claim 1 wherein said control motor has a grounded ground terminal and a single hot terminal, said start switch being an SPDT switch having a pole connected to said hot terminal and a pair of contacts, said control means including further cam-operated switch means for connecting one of said poles to ground and the other to said hot side in the fully retracted position of said starter gear, for connecting both of said poles to said hot side when said starter gear is between its said positions, and for connecting the other of said poles to ground and said one pole to said hot side in the fully advanced position of said starter gear.

19. The mechanism defined in claim 1 wherein said control motor is of the two-speed type and has a grounded ground terminal, a low-speed hot terminal, and a high-speed hot terminal, said assembly further comprising a source of electricity having a hot side and a grounded side, said start switch being a pair of alternately closable front and back SPST start switches, said control means including a pair of alternately closable front and back SPST control switches, said back control switch being closed when said gear is out of said advanced position, said low-speed terminal being connected through said back control switch and said front start switch to said hot side, said control means including a cam-operated SPDT switch having a pole, a ground contact engaged by said pole in said retracted position of said starter gear, and another contact connected to said hot side of said source, said high-speed terminal being connected through said back start switch with said pole, said start motor having a ground terminal connected to ground and a hot terminal connected through said front control switch with said hot side.

20. The mechanism defined in claim 1 wherein said control motor includes a fractional-horsepower electric motor having an output element constituted as a worm, and a large-diameter gear meshing with said worm and fixed to said cam.

* * * * *